United States Patent [19]

Ticker

[11] 3,981,252

[45] Sept. 21, 1976

[54] NON-POLLUTING DISPOSAL OF ANTIFOULING PAINT RESIDUES ENCOUNTERED IN SHIPYARD ABRASIVE BLASTING OPERATIONS

[76] Inventor: Arthur Ticker, 12117 Maddox Lane, Bowie, Md. 20715

[22] Filed: Dec. 3, 1975

[21] Appl. No.: 637,421

[52] U.S. Cl. ..... 110/18 R; 110/8 A; 134/19; 75/77; 75/85

[51] Int. Cl.[2] ..... F23G 7/00

[58] Field of Search ..... 110/7 R, 8 R, 8 A, 18 R; 134/2, 19; 75/77, 85

[56] References Cited

UNITED STATES PATENTS

| | | | |
|---|---|---|---|
| 2,474,645 | 6/1949 | Baxter | 75/85 X |
| 2,815,267 | 12/1957 | Platteeuw et al. | 75/85 |
| 3,686,034 | 8/1972 | Rothschild | 134/19 X |
| 3,802,916 | 4/1974 | Jackson | 134/19 X |
| 3,821,026 | 6/1974 | Swartz | 134/2 |
| 3,847,664 | 11/1974 | Gravel | 134/2 |
| 3,899,322 | 8/1975 | Yosim et al. | 134/2 |

*Primary Examiner*—Kenneth W. Sprague
*Attorney, Agent, or Firm*—R. S. Sciascia; Q. E. Hodges; D. McGiehan

[57] ABSTRACT

A process for neutralizing the toxic nature of organo-metallic antifouling (AF) paint particles, in intimate mixture with spent abrasive particles, derived from the abrasive blasting of ships' hulls. The spent abrasive containing the organo-metallic paint residue is collected and heated in a vapor-tight furnace which is fitted with a safety pressure release valve. When the ignition temperature of the organo-metallic paint is exceeded, the organo-metallic paint particles are oxidized to a harmless, non-toxic metal oxide, which may be safely disposed of. Volatile organo-metallic paint vapors are drawn through an after-burner so that exhaust residue consist only of non-polluting carbon dioxide and water vapor. Metallic elements of commercial value, such as tin, may be recovered from the processed abrasive, which may also be reusable. To ensure complete combustion, air is fed into the combustion furnace from a blower fan, compressor, or other external source.

7 Claims, No Drawings

NON-POLLUTING DISPOSAL OF ANTIFOULING PAINT RESIDUES ENCOUNTERED IN SHIPYARD ABRASIVE BLASTING OPERATIONS

The invention described herein may be manufactured and used by or for the Government of the United States of America for governmental purposes without the payment of any royalties thereon or therefor.

BACKGROUND OF THE INVENTION

A well known maintenance procedure in ship overhaul work requires the removal or cleaning, and then the replacement of frequent intervals, of ships' hull bottom antifouling (AF) paints which are used to prevent attachment and progressive growth of sea life. Operating requirements of todays high speed Navy have imposed severe demands on ships coating systems, especially on antifouling paints. Fuel conservation, high speed capabilities, and extended periods between ship drydockings are Naval objectives which depend to a great extent on the performance of antifouling (AF) paints.

The best known prior art antifouling paints were the old stand-by cuprous oxide paints which operate on the principle of leaching out, at a controlled rate, a toxic solution to kill or discourage sea life from attaching to the ships' bottom. The cuprous oxide paints leached at a high rate in order to perform their function, and therefore had to be mechanically removed and renewed at frequent intervals. For example, one could expect an effective life of only six to 18 months, thus, one had to accept the low efficiency of a "dirty bottom" or the "down time" of drydocking.

To overcome these difficulties, and to achieve the desired objectives discussed above, the old cuprous oxide AF paints are being rapidly replaced by new, improved AF paints and coatings containing organometallic compounds, such as for example, tributyl tin oxide (TBTO), tributyl tin fluoride (TBTF), tripropyl tin oxide (TPrTO), and tripropyl tin fluoride (TPrTF), etc. Also, toxic organo-metallic compounds of lead and other heavy metals, such as for example, triphenyl lead acetate, may be used. The advantage of these new organo-metalic AF paints over the previous cuprous oxide type AF paints is that they are far more toxic to sea life and can be designed with very low leach rates to perform their AF function. Their antifouling life may thus be prolonged to a projected five year period. However, ships' hulls bearing these organo-metallic AF coatings do eventually require abrasive blasting to facilitate repainting. Since these organo-metallic compounds, particularly the commonly used organo-tins, are not biodegradable, remain toxic for long periods, are approximately 20 times more toxic than cuprous oxide, they therefore cannot be allowed to contaminate the water environment i.e., harbor, and disposal of the spent abrasive material containing these paint residues has become a serious problem of growing proportions.

The current shipyard practice for disposal of spent abrasive materials containing organo-tin AF paint residues involves shoveling or otherwise collecting the material from the floor of the drydock into 55 gallon metal drums which are then sealed and transported to designated class 1 landfill sites for burial. A class 1 landfill offers minimal seepage risks. This procedure is unsatisfactory because: (1) a class 1 landfill is not always available. For example, Hawaii does not have a class 1 landfill. Tons of the contaminated spent abrasive have therefore accumulated at Pearl Harbor awating shipment to the mainland states for disposal, (2) the period over which the material remains toxic while underground has not been established. It is known that organo-tin compounds degrade under the influence of ultra violet light from sunlight and by the action of some soil bacteria. However, packaging the material in metal drums effectively shields the organo-tin compounds from both the ultra violet and the soil bacteria. (3) The process does not really solve the pollution problem. It only transfers the pollutant from one environment to another. (4) The process serves to concentrate the pollutant into discrete areas or pockets beneath the ground. This could cause problems in the future.

SUMMARY OF THE INVENTION

Briefly, the instant invention overcomes the disadvantages of the prior art disposal methods and the possible toxic pollution threat of organo-metallic antifouling paints by providing a method of on-site detoxification for such materials removed by abrasive blasting or other mechanical techniques. Essentially the method comprises the steps of collecting the residue of particles of organo-metallic antifouling paint along with the abrasive material where used to remove it; placing the residues in a vapor tight furnace; heating it in the presence of air for a period of time to exceed its ignition temperature and thus destroy the organic portion of the molecule to detoxify the organo-metallic material to harmless carbon dioxide, water vapor, and a non-organic metal oxide; and unloading the detoxified material for recycling or safe disposal.

OBJECTS OF THE INVENTION

Accordingly, an object of the present invention is to provide a new and improved safe method of disposal of organo-metallic materials.

Another object of the instant invention is to provide a safe detoxifying method for organo-metallic antifouling paint particles removed by abrasive blasting techniques from ship's hulls.

A further object of the present invention is to provide mobile, on-site method of reducing a toxic organo-metallic residue compound to an inorganic oxide.

Still another object of the invention is to provide an inexpensive, clean, and almost 100% efficient method of handling and detoxifying organo-metallic antifouling paints removed by abrasive blasting.

A still further object of the instant invention is to provide a complete method of collecting, reducing to an environmentally safe material and separating for recycling or disposal from abrasive blasting materials, a toxic organo-metallic residue of antifouling paint removed from a ship's hull.

DESCRIPTION OF THE PREFERRED EMBODIMENT

A more complete understanding of the invention and many of the attendant advantages thereto will be readily appreciated as the same become better understood by reference to the following detailed description.

As is well known in the merchant marine industry and the Naval Establishment, a ship requires drydocking in a graving dock of a shipyard for periodic cleaning and replacement of the antifouling coatings on the hull below the waterline. As discussed above, the more modern AF coatings are more highly toxic and are designed to have a lower leach rate and thus a longer service life. Concomitantly, and unfortunately, the coating's residue when removed and disposed of is still toxic and can contaminate man or animals, and their environments.

These spent toxic antifouling coatings, generally in the form of a paint, are removed from the hull after the graving dock is closed and pumped down. The removal technique is generally abrasive blasting, that is abrasive particles such as sand, slag, or metallic particles propelled against the hull by an air jet to break up and remove the paint in particles. Water may be included to reduce the dust. Another, less effective method is by the use of power driven wire brushes and chipping wheels. This removal or cleaning of the spent coating facilitates proper repainting.

The spent abrasive particles and toxic organo-metallic antifouling paint particulate residue combined falls to the bottom of the drydock, or alternatively may be caught in drop clothes. The combined particles are then swept and shoveled up, or otherwise collected into a cart, crane bucket, or truck. A batch of these combined particles are then placed in a vapor-tight furnace, fitted with a pressure relief valve to prevent build up of high pressures within the furnace. Provision is made in the furnace for the addition of air, fed from a blower fan, compressor, or other external source, so as to replace consumed oxygen and thus ensure complete combustion of all organic material. The furnace and its contents are raised to a temperature of approximately 640°C for a period of approximately 45 minutes. This temperature and time, plus the aforementioned air, causes combustion of the toxic organo-metallic paint particles, and oxidizes it to a non-toxic, non-organic metal oxide. Generally nothing happens to the abrasive blasting material, because it is inert sand or slag to begin with.

The now detoxified particulate combination of the inorganic metal oxide and the abrasive may be dumped or otherwise unloaded, after the furnace is opened into trucks, carts, crane buckets, or the like for ordinary disposal almost anywhere since the contents do not pose a threat to animal, man, or plant life. Alternatively, the metal oxide may be reclaimed and recycled for other uses, after separation from the abrasive material by means well known in the art. Also the abrasive, if not excessively fragmented or powdered may be reclaimed for use again in abrasive blasting.

It is to be understood at this point, that this method is applicable and feasible for use with any of the commonly used organo-metallic antifouling paint compounds such as organo-tins, organo-leads, etc. The furnace will detoxify any of them to a safe oxide that may be readily disposed of as discussed above.

An alternative to a vapor-tight furnace having a pressure relief valve, is an open furnace having an after-burner connected to the furnace for igniting and combusting the volatile vapors given off by the organo-metallic residues prior to combustion.

A further variation of the subject process would utilize a fluidized bed-type furnace for the detoxification of the organo-metallic paint particles; either with or without an after-burner, as required.

An additional feature of this invention would be to mount the equipment on a flat bed truck or mobile skid to provide mobility for the process, so that the equipment could be positioned along-side a drydock at street level, as required. The spent contaminated abrasive would then be vacuumed by conventional equipment from the drydock floor to the street level directly into the detoxification unit with a minimum of handling by personnel, and a minimum of pollution risk to the environment.

Obviously, numerous modifications and variations of the present invention are possible in light of the above teachings. It is therefore to be understood that, within the scope of the appended claims, the invention may be practiced otherwise than as specifically described.

What is claimed is:

1. A safe, non-polluting method of handling and neutralizing the toxic nature of organo-metallic antifouling paint residue removed from ships comprising the steps of:

removing the organo-metallic antifouling paint from a ship's hull as by abrasive blasting or other mechanical means;

collecting the residue of said organo-metallic antifouling paint and spent abrasive blasting material;

placing said residue of organo-metallic paint and abrasive material in a vapor-tight muffle furnace;

heating said residue in said furnace in the presence of air for a period of time above its ignition temperature and the ignition temperature of its vapors;

whereby said organo-metallic material is destroyed to yield carbon dioxide, water vapor and a non-toxic, non-organic metal oxide; and unloading the detoxified material for recycling or safe disposal.

2. The method of claim 1 wherein the step of heating is further defined as:

heating said residue to a temperature of at least 640°C for at least 45 min.

3. The method of claim 2 further comprising the step of:

adding air to the interior of said furnace to replace consumed oxygen, and to fluidize particulates and thus ensure complete combustion of said organo-metallic and its vapors.

4. The method of claim 3 further comprising the steps of:

venting the vapors driven off during the combustion of the organo-metallic residue to an after-burner; and afterburning said vapors to non-toxic inert compounds.

5. The method of claim 4 wherein said organo-metallic residue is:

an organo-tin compound.

The method of claim 4 wherein said organo-metallic residue is:

an organo-lead compound.

6. The method of claim 5 wherein said organo-metallic residue is:

triphenyl lead acetate.

7. The method of claim 1 wherein said steps of collecting said residue is provided by a mobile on-site process comprising the initial step of:

vacuuming up the residue from the drydock floor to street level directly into said furnace.

* * * * *